US007986286B2

(12) United States Patent
Park et al.

(10) Patent No.: US 7,986,286 B2
(45) Date of Patent: Jul. 26, 2011

(54) ORGANIC ELECTRO-LUMINESCENT DISPLAY AND METHOD OF MAKING THE SAME

(75) Inventors: Young-Jong Park, Seoul (KR); Hyo-jin Lee, Seoul (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 900 days.

(21) Appl. No.: 11/951,517

(22) Filed: Dec. 6, 2007

(65) Prior Publication Data

US 2008/0218450 A1 Sep. 11, 2008

(30) Foreign Application Priority Data

Mar. 8, 2007 (KR) ..... 10-2007-0022935

(51) Int. Cl.
*G09G 3/30* (2006.01)

(52) U.S. Cl. ..... 345/77; 345/690

(58) Field of Classification Search ..... 345/36, 345/39, 42–46, 76–83, 204, 690–691; 315/169.3
See application file for complete search history.

(56) References Cited

U.S. PATENT DOCUMENTS

| | | | | |
|---|---|---|---|---|
| 2003/0234753 | A1* | 12/2003 | Tanaka | 345/67 |
| 2005/0280869 | A1* | 12/2005 | Kameyama | 358/3.01 |
| 2006/0220578 | A1* | 10/2006 | Park et al. | 315/169.3 |
| 2007/0103410 | A1* | 5/2007 | Oh | 345/77 |

FOREIGN PATENT DOCUMENTS

| | | |
|---|---|---|
| JP | 2006-31682 | 2/2006 |
| KR | 10-436231 | 6/2004 |
| KR | 2004-57419 | 7/2004 |
| KR | 2006-33706 | 4/2006 |
| KR | 2006-104855 | 10/2006 |

OTHER PUBLICATIONS

Office Action issued by the Korean Intellectual Property Office on May 29, 2008 in Korean Patent Application No. 2007-22935.
English Language Abstract for KR 2000-44751.

* cited by examiner

*Primary Examiner* — Amare Mengistu
*Assistant Examiner* — Hong Zhou
(74) *Attorney, Agent, or Firm* — Christie, Parker & Hale, LLP

(57) ABSTRACT

An organic electro-luminescent display and a making method of the same. The organic electro-luminescent display according to the present invention includes a luminance control unit including a data sum-up unit to generate a frame data; a look-up table for storing an information corresponding to the light emission control signal to correspond to the frame data; an operator unit to generate a look-up table by using a value at the beginning step of luminance reduction, a value at the final step of luminance reduction, a pulse width of the light emission control signal at the beginning step of luminance reduction, and a pulse width of the light emission control signal at the final step of luminance reduction; and a luminance control signal driver for outputting a luminance control signal using the information corresponding to the light emission control signal stored in the look-up table.

14 Claims, 4 Drawing Sheets

ORGANIC ELECTRO-LUMINESCENT DISPLAY AND METHOD OF MAKING THE SAME

CROSS-REFERENCE TO RELATED APPLICATION

This application claims the benefit of Korean Application No. 2007-22935, filed Mar. 8, 2007, in the Korean Intellectual Property Office, the disclosure of which is incorporated herein by reference.

BACKGROUND OF THE INVENTION

1. Field of the Invention

Aspects of the present invention relate to an organic electro-luminescent display and a method of making the same.

2. Description of the Related Art

In recent years, a variety of flat panel displays have been developed, which have lower weight and volume than cathode ray tubes. In particular, organic light emitting diode display devices have attracted public attention for having excellent luminous efficiency, luminance, and viewing angle, as well as a rapid response time.

The organic electro-luminescent display displays an image using plurality of organic light emitting diodes (OLED). An organic light emitting diode includes an anode electrode, a cathode electrode, and an organic light emission layer arranged between the anode electrode and the cathode electrode. An organic light emitting diode emits light by coupling electrons with holes.

If an electric current flowing in the organic light emitting diodes is high, the organic light emitting diodes display a high luminance. If an electric current flowing in the organic light emitting diodes is low, the organic light emitting diodes display a low luminance. Therefore, grey levels are displayed by controlling the electric current flowing in the organic light emitting diodes.

For this purpose, a larger electric current is applied, if the total brightness of one image displayed in the organic electro-luminescent display is high, as opposed to if the total brightness of one image is low. The contrast of the organic electro-luminescent display is reduced, due to a smaller apparent difference in the brightness between a high grey level and a low grey level, if one image is displayed with a higher total grey level.

Accordingly, in order to solve the above problems, some display devices use of a power supply unit that produces a large flow of high voltage electric current, which increases production costs. Also, a sudden increase in the electric current may cause a driving interruption.

SUMMARY OF THE INVENTION

Aspects of the present invention relate to an organic electro-luminescent display that can limit its power consumption, by limiting the total brightness of an image, according to a sum or grey levels input to a pixel unit. The total brightness can be controlled by configuring a look-up table, and limiting an electric current according to the look-up table. Aspects of the present teaching also relate to a driving method of an organic electro-luminescent display.

Aspects of the present invention provide an organic electro-luminescent display including: a pixel unit to display an image including of a plurality of frames, corresponding to a scan signal, a light emission control signal, and a data signal; a scan driver to supply the scan signal and the light emission control signal to the pixel unit; a data driver to generate the data signal from video data and to supply the generated data signal to the pixel unit; a luminance control unit to control a pulse width of the light emission control signal, using frame data, which is a sum of video data input to one frame; and a power supply unit including a first power source and a second power source, to respectively supply a first current and a second current to the pixel unit. The luminance control unit includes a data sum-up unit to generate the frame data; a look-up table (memory) to store information corresponding to the light emission control signal and the frame data; an operator unit to generate the look-up table, by using a value of a beginning step of luminance reduction, a value of a final step of luminance reduction, a pulse width of a light emission control signal corresponding to the beginning step of luminance reduction, and a pulse width of a light emission control signal corresponding to the final step of luminance reduction; and a luminance control signal driver to output a luminance control signal using the information corresponding the look-up table.

Aspects of the present invention relate to a method for making an organic electro-luminescent display, which displays an image to correspond to a scan signal and a light emission control signal. The image is composed of a plurality of frames. The method includes: setting a luminance reduction range corresponding to a light emitting area; setting a luminance reduction value using a value at a final step of luminance reduction, a pulse width of a light emission control signal relating to the value of the beginning step of luminance reduction, and a pulse width of a light emission control signal relating to the value of the final step of luminance reduction; and storing a pulse width of the light emission control signal corresponding to the beginning step of luminance reduction, at a step prior to the beginning step of luminance reduction; and generating an increase/decrease in the pulse width of the light emission control signal, at a step between at a step next to the beginning step of luminance reduction and the final step of luminance reduction, so as to correspond to the value at the beginning step of luminance reduction, the value at the final step of luminance reduction, the pulse width of the light emission control signal at the beginning step of luminance reduction, and the pulse width of the light emission control signal at the final step of luminance reduction at the final step of luminance reduction, thereby to generate pulse widths of the light emission control signal.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
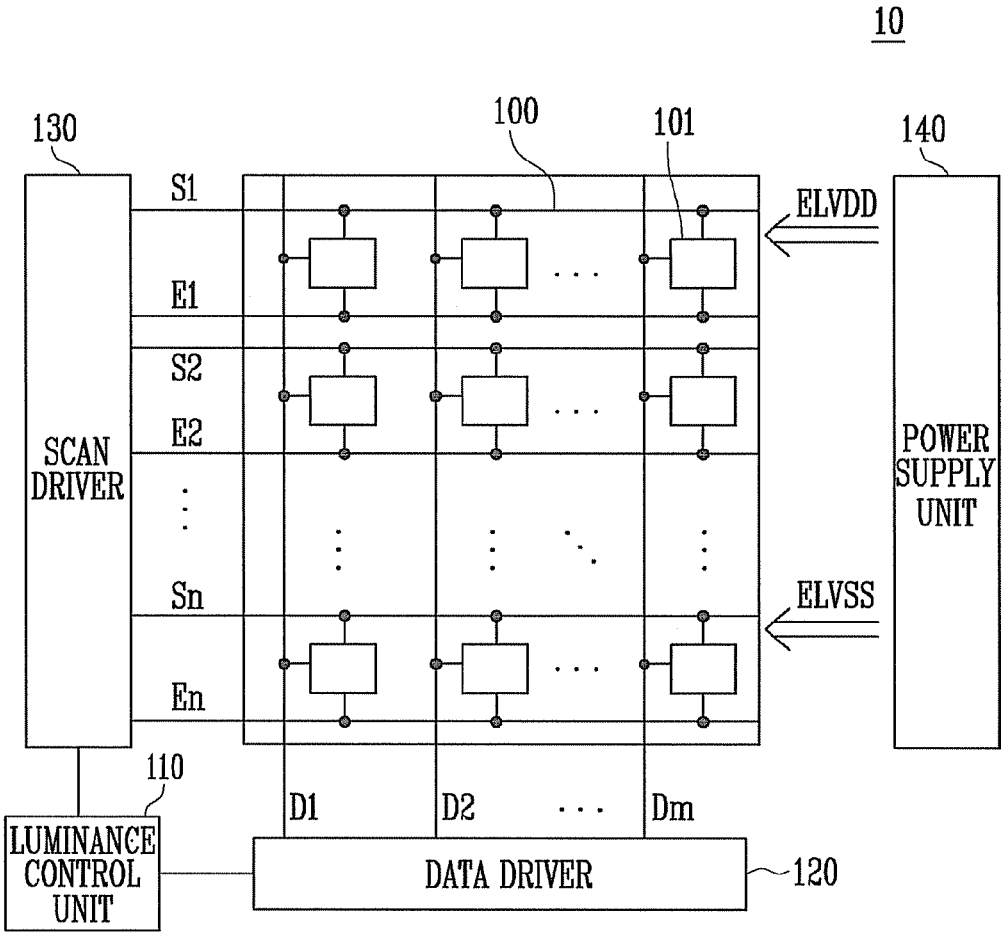
FIG. 1 is a schematic view showing a configuration of an organic electro-luminescent display, according to an exemplary embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is a schematic view showing a configuration of an organic electro-luminescent display 10, according to an exemplary embodiment of the present invention. Referring to FIG. 1, the organic electro-luminescent display 10 includes a pixel unit 100, a luminance control unit 110, a data driver 120, a scan driver 130, and a power supply unit 140.

The pixel unit 100 comprises a plurality of pixels 101 arranged therein, and a light emitting device (not shown), for example, an organic light emitting diode, is coupled to each of the pixels 101 to emit light in response to the flow of an electric current to each of the pixels 101. The pixel unit 100: includes n scan lines (S1, S2, . . . Sn−1, Sn) disposed in a horizontal direction, to supply scan signals; n light emission control signal lines (E1, E2, . . . En−1, En), to supply a light emission control signal; and m data lines (D1, D2, . . . Dm−1, Dm) disposed in a vertical direction, to supply data signals. The pixel unit 101 receives a first voltage (ELVDD) and a second voltage (ELVSS), from the power source 140, when the pixel unit 101 is driven. The power source 140 can comprise two power supply units (not shown) Accordingly, the pixel unit 101 displays an image by controlling the application of the first and second voltages ELVDD and ELVSS to the pixels 101, according to the scan signal and the data signal.

The pixel unit 100 displays an image with a high luminance, when a large number of the pixels 101 emit light with a high luminance, and accordingly, the sum of the input data is large. The pixel unit 100 displays an image with a low luminance, when a small number of pixels emit light with a high luminance, and accordingly, the sum of the input data is small. If the pixel unit 100 displays a high luminance image, glaring and the like may result, and a power consumption may be high.

The luminance control unit 110 reduces the power consumption, by estimating a brightness per frame, and limiting an electric current flowing in the pixel unit, accordingly. A control signal of the luminance control unit 110 may be a clock, a horizontal synchronizing signal, a vertical synchronizing signal and/or a luminance control signal.

Limiting the electric current, according to the brightness of a frame, results in a greater difference in grey levels (contrast), by limiting the overall brightness of the frame. In other words, if the total brightness of a frame is low, the frame will have a higher apparent contrast than if the total brightness of a frame is high. A greater grey level contrast results in improved image visibility. For example, if most of a frame is displayed with a low grey level and some of the frame is displayed with a high grey level, that is, if bright light is emitted from a portion of a dark screen, then the contrast between the grey levels is increased, resulting in improvement in visibility. If most of one frame is displayed with a high grey level, and some of one frame is displayed with a low grey level, then the contrast between the grey levels is decreased, resulting in glaring and the like. Limiting the electric current lowers the brightness of the portion of the frame displayed with the high grey level, resulting in improved contrast and visibility.

The data driver 120 receives video data having red, blue, and green components, to generate a data signal and supplies the data signal to the pixel unit 100. The data driver 120 is coupled to the data lines (D1, D2, . . . Dm−1, Dm) of the pixel unit 100, to supply the data signal to the pixel unit 100.

The scan driver 130 applies a scan signal and a light emission control signal to the pixel unit 100. The scan driver 130 is coupled to the scan lines (S1, S2, . . . Sn−1, Sn) and the light emission signal lines (E1, E2, . . . En−1, En), to supply the scan signal and the light emission control signal to certain rows of the pixel unit 100. The data signal output from the data driver 120 is supplied to the pixel unit 100 and to the pixels 101, to which the light emission control signal is supplied. The pixels 101 emit light, according to the light emission control signal.

The data signal input from the data driver 130 is applied to certain rows of the pixel unit 100, to which the scan signal is supplied. Then a light emission time, during which an electric current corresponding to the data signal is supplied to the organic light emitting diode, is determined using a pulse width of the light emission control signal. The data driver 130 controls a light emission time of the organic light emitting diodes. The pulse width of the light emission control signal is determined using the luminance control signal. The luminance control signal is generated in the luminance control unit 110.

The scan driver 130 may comprise: a scan drive circuit to generate a scan signal; and a light emission drive circuit to generate a light emission control signal. The scan drive circuit and the light emission drive circuit may be provided in one component, or in separate components.

A data signal input in the scan driver unit 130 is applied to a row of the pixel unit 100, to which the scan signal and the emission control signal are each transmitted, and an electric current, corresponding to the light emission control signal and the data signal, is transmitted to the light emitting device, to display an image. One frame is completed if all rows are sequentially selected.

The power supply unit 140 supplies the first voltage (ELVDD), which is produced by the first power supply, and the second voltage (ELVSS), which is produced by the second power supply, to the pixel unit 100 to allow an electric current, corresponding to the data signal to flow in each of the pixels, due to a voltage difference between the first voltage (ELVDD) and the second voltage (ELVSS). If the sum of video data input to one frame is high, a power consumption is not increased, due to a high luminance range limit. The high luminance range limit results in a reduction in the power consumption.

Figure 2:
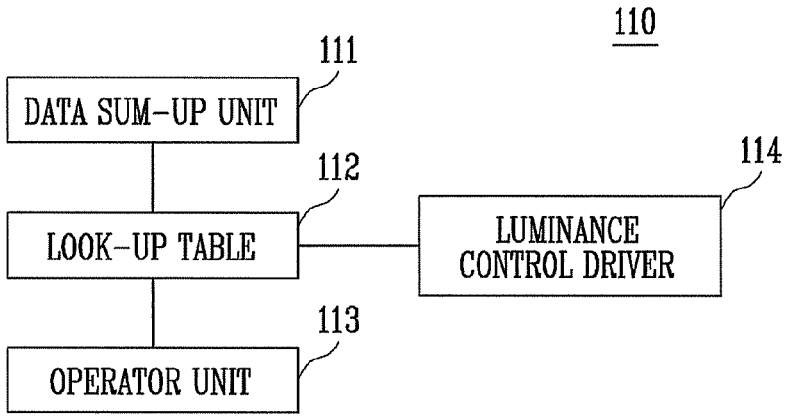
FIG. 2 is a schematic view showing blocks of a luminance control unit, as shown in FIG. 1.

FIG. 2 is a schematic view showing blocks of a luminance control unit 110, as shown in FIG. 1. Referring to FIG. 2, the luminance control unit includes a data sum-up unit 111, a look-up table 112, an operator unit 113, and a luminance control driver 114.

The data sum-up unit 111 calculates a sum of video data input to one frame, and the data sum-up unit 111 sums grey level values of the input video data. The sums of the grey level values are referred to as frame data. It can be estimated that if a large number of the pixels emit a high luminance, the frame data has a high value. It may be estimated that if a small number of the pixels emit at a high luminance, the summed frame data has a small value. A luminance range limit is determined by the sum of the frame data.

The look-up table 112 stores a pulse width of light emission control signal which is formed according to a luminance range limit estimated using the sum of the video data sum in the data sum-up unit 111. Additionally, the look-up table 112 may store the pulse number and a gap inter the pulses. One example of the look-up table 112 is listed in the following Table 1.

TABLE 1

| Binary numeral | Decimal numeral | Light emitting area | Light emission ratio | Luminance (cd/m$^2$) | Pulse width (100 μs) |
|---|---|---|---|---|---|
| 00000 | 0 | 0% | 100% | 300 | 2 |
| 00001 | 1 | 4% | 100% | 300 | 2 |
| 00010 | 2 | 7% | 100% | 300 | 2 |
| 00011 | 3 | 11% | 100% | 300 | 2 |
| 00100 | 4 | 14% | 100% | 300 | 2 |
| 00101 | 5 | 18% | 100% | 300 | 2 |
| 00110 | 6 | 22% | 100% | 300 | 2 |
| 00111 | 7 | 25% | 100% | 300 | 2 |
| 01000 | 8 | 29% | 100% | 300 | 2 |
| 01001 | 9 | 33% | 100% | 300 | 2 |
| 01010 | 10 | 36% | 100% | 300 | 2 |
| 01011 | 11 | 40% | 100% | 300 | 2 |
| 01100 | 12 | 43% | 100% | 300 | 2 |
| 01101 | 13 | 47% | 97% | 291 | 12 |
| 01110 | 14 | 51% | 94% | 282 | 22 |
| 01111 | 15 | 54% | 91% | 272 | 32 |
| 10000 | 16 | 58% | 88% | 263 | 42 |
| 10001 | 17 | 61% | 85% | 254 | 52 |
| 10010 | 18 | 65% | 82% | 245 | 62 |
| 10011 | 19 | 69% | 78% | 235 | 72 |
| 10100 | 20 | 72% | 75% | 226 | 82 |
| 10101 | 21 | 76% | 72% | 217 | 92 |
| 10110 | 22 | 79% | 69% | 208 | 102 |
| 10111 | 23 | 83% | 66% | 198 | 112 |
| 11000 | 24 | 87% | 63% | 189 | 122 |
| 11001 | 25 | 90% | 60% | 180 | 132 |
| 11010 | 26 | 94% | 57% | 171 | 142 |
| 11011 | 27 | 98% | 54% | 162 | 152 |
| 11100 | 28 | 100% | | | |
| 11101 | 29 | 100% | | | |
| 11110 | 30 | 100% | | | |
| 11111 | 31 | 100% | | | |

In Table 1, the pulse width of the light emitting period in the light emission control signal is set, according to the sum of the input data added by the sum-up unit 111. The width of the light emitting period is set using upper bits of the data, showing the total sum of the input data. The luminance (brightness level) of the pixel unit 100 may be calculated in one frame using the upper 5 bits of the total sum of the input data. In this embodiment, it is set to the upper 5 bits, but the number of the upper bit can be adjusted, in other embodiments.

The binary numerals represents the upper 5-bit values, which is are sums of the grey levels of frames of video data (frame data amounts). The decimal numerals represent the binary numerals converted to decimal numerals. The light emitting area represents a ratio of a grey level value (sum) of the current frame, to a grey level value of a portion of an entire frame emitting only white light. In other words the light emitting area is an estimated area of a frame emitting white light having the same luminescence as the current frame. For example, when a total grey level of a current frame is 4, an equivalent grey level could be produced by 14% of a white light emitting frame. The total luminance of a frame is low, if the light emitting area is small. The total luminance of a frame is high, if the light emitting area is large.

The light emission ratio represents a percentage of a time when pixels emit light, during a light emission control signal. A light emission time is longer, if the light emission ratio is larger, and a light emission time is shorter, if the light emission ratio is smaller.

The luminance represents a luminance of a pixel emitting white light. Pixels emitting light in a frame display the maximum luminance, if the light emitting area is less than a predetermined light emitting area. The maximum luminance of the pixels is gradually decreased, as the light emitting area becomes greater than the predetermined light emitting area.

The pulse width represents a pulse duration of a light emission control signal, during which the pixels do not emit light. As the light emitting area increases, the pulse width also increases. A longer pulse width shortens a time during which the pixels emit light during a frame.

Table 1 is a look-up table 112 in which an emission ratio, namely, a ratio between a predetermined period, and a period in which the luminance emitted in one frame period is limited to 50% of the maximum value, according to the luminance of the pixel unit 100. The predetermined period may be one frame period, or a period shorter than one frame period.

The operator unit 113 generates the look-up table 112. Data for setting pulse widths of the look-up table 112 is stored by the operator unit 113. However, in order to store all data in the look-up table 112, to generate a light emission control signal, a large number of commands may be required. In order to solve this problem, all of the data is set to a predetermined value, rather than input into the look-up table 112 individually, and the predetermined value is calculated using the operator unit 113, and then the calculated value is stored in the look-up table 112.

The luminance control driver 114 generates a luminance control signal corresponding to a light emission control signal that is assigned according to a luminance range limit. The luminance control signal is input to the scan driver, to generate a light emission control signal in the scan driver, corresponding to the luminance control signal. For example, a luminance control signal can be generated to produce a light emission control signal, such that a total luminance of a frame is within a particular range. The range can be set, such that a total current supplied to the pixels 101 does not exceed a particular current level.

Figure 3:
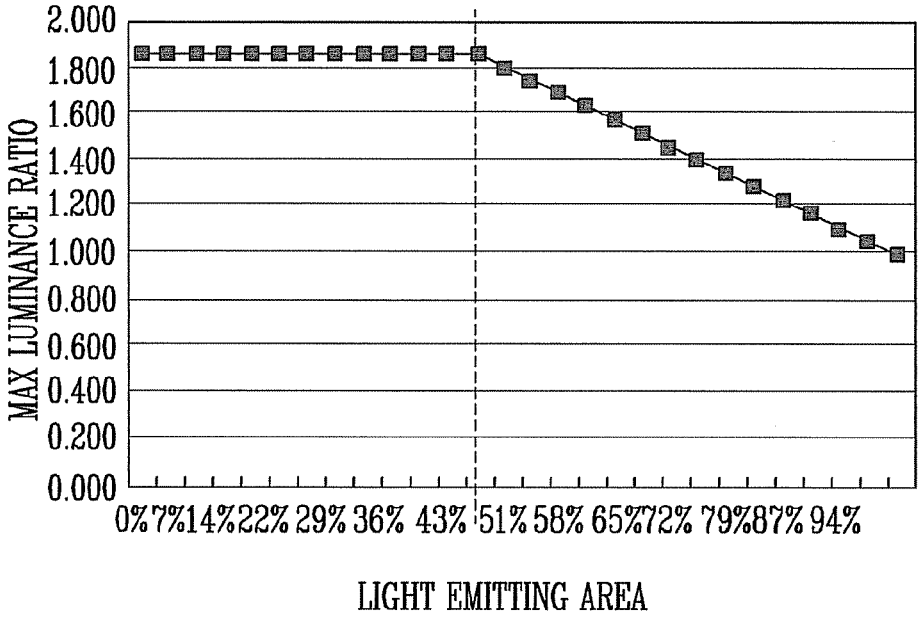
FIG. 3 is a graph showing change in luminance according to a light emitting area in the organic electro-luminescent display, according to an exemplary embodiment of the present invention.

FIG. 3 is a diagram showing a relationship between the light emitting area and the max brightness ratio, as calculated mathematically, in the organic electro-luminescent display 10, according to aspects of the present invention. The horizontal axis represents a light emitting area, and the vertical axis represents a luminance ratio between a minimum luminance of a pixel and a maximum luminance of a pixel. The graph indicates that a luminance of pixels receiving the same grey level value is changed, to correspond to the light emitting area.

Referring to FIG. 3, a ratio of the maximum luminance is not changed, if the light emitting area is less than a reference value of about 43%. The maximum luminance decreases, if the light emitting area is greater than the reference value of 43%. That is to say, if the entire luminance of one frame is greater than a predetermined value (reference value), then a luminance is reduced by controlling a pulse width of the light emission control signal. Therefore, an electric current flowing in the pixels 101 unit does not cause the pixels 101 to exceed the predetermined value.

Figure 4:
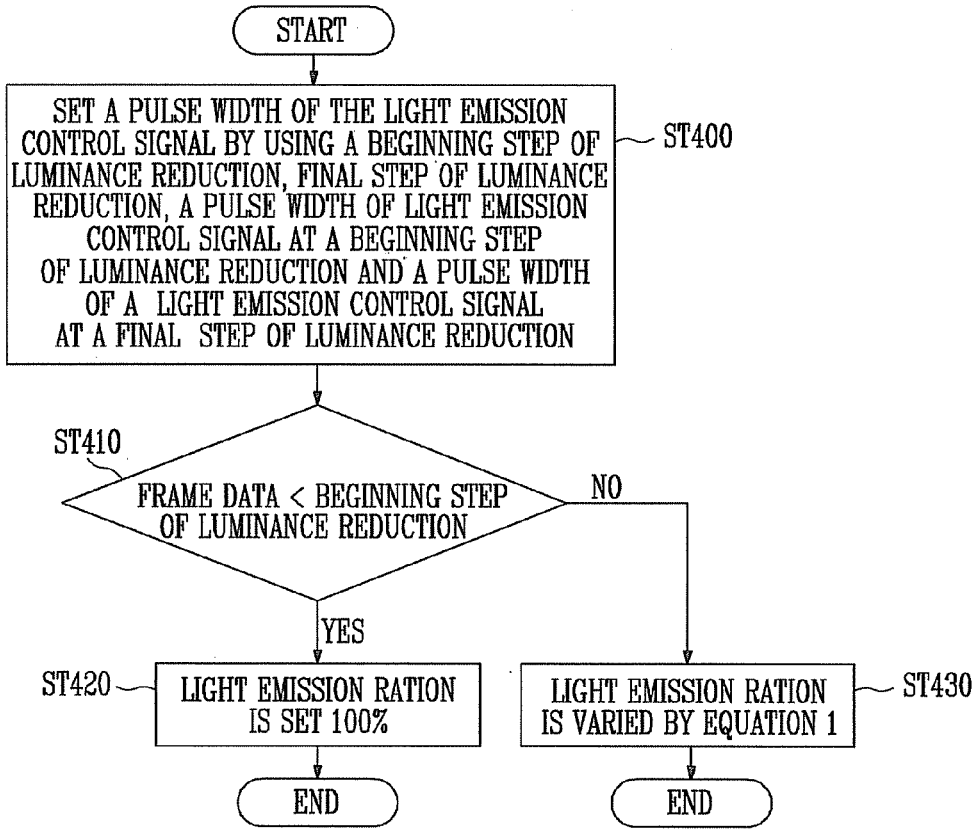
FIG. 4 is a flow chart showing a step of forming a look-up table in the organic electro-luminescent display, according to an exemplary embodiment of the present invention.

FIG. 4 is a flow chart showing a method to form a look-up table 112 in the organic electro-luminescent display 10. Referring to FIG. 4, Step 1 (ST 400): set a pulse width of the light emission control signal by using a first standard of luminance reduction, a final standard of luminance reduction, a pulse width of a light emission control signal at a first standard of luminance reduction, and a pulse width of a light emission control signal at a final standard of luminance reduction.

In the look-up table as listed in Table 1, the first standard of luminance reduction is set to decimal numeral 12, the final standard of luminance reduction is set to decimal numeral 27, the pulse width of the light emission control signal at the first standard of luminance reduction is set to 2, and the pulse width of the light emission control signal at the final standard of luminance reduction is set to 152.

The standards, which are displayed as the decimal numeral or the binary numeral in the look-up table, are distinct according to the size of the frame data inputted to one frame.

Step 2 (ST 410): estimate a size of the frame data with grey levels and compare the size of the frame data with that of a frame data at the first standard of luminance reduction.

Step 3 (ST 420): determine a pulse width of the light emission control signal as a pulse width of the light emission control signal, which is set at the first standard of luminance reduction, and store the pulse width of the light emission control signal in the look-up table if the size of the frame data is smaller than the frame data at the first standard of luminance reduction.

Step 4(ST 430): change a pulse width of the light emission control signal on the basis of the following Equation 1 if the size of the frame data is higher than the frame data at the first standard of luminance reduction.

$$Value_{In/De} = \frac{Pulse_{final} - Pulse_{beginning}}{Value_{final} - Value_{beginning}} \quad \text{Equation 1}$$

wherein $Vaue_{In/De}$ represents an increase/decrease in a pulse width.

$Pulse_{final}$ represents a pulse width of a light emission control signal at the final standard of luminance reduction, $Pulse_{beginning}$ represents a pulse width of a light emission control signal at the first standard of luminance reduction, $Value_{final}$ represents a value at the final standard of luminance reduction, and $Value_{beginning}$ represents a value at the first standard of luminance reduction.

That is to say, the pulse width is increased by 10 since the increase/decrease in a pulse width becomes (152−2)/(27−12) if the first standard of luminance reduction is set to decimal numeral 12, the final standard of luminance reduction is set to decimal numeral 27, the pulse width of the light emission control signal at the first standard of luminance reduction is set to 2, and the pulse width of the light emission control signal at the final standard of luminance reduction is set to 152, as listed in Table 1. Accordingly, the pulse width of the light emission control signal is increased by 10 since the pulse width is set to 2 in the standards 0-12, set to 12 in the standard 13, and set to 22 in the standard 14, respectively.

Figure 5:
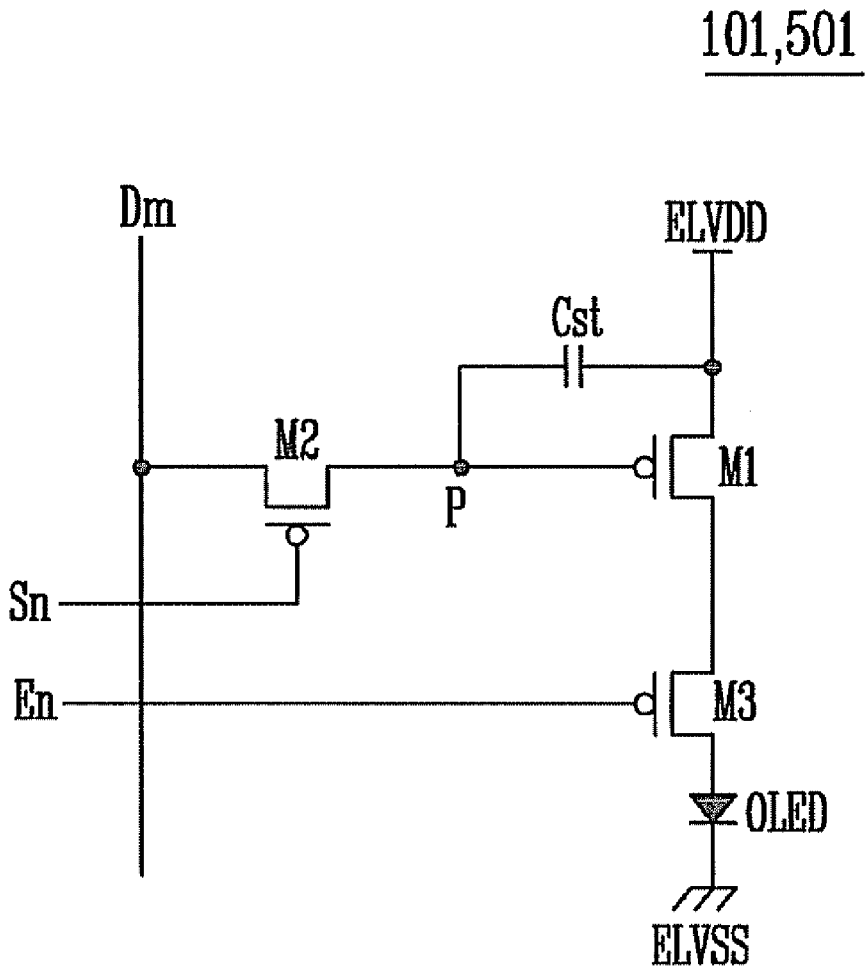
FIG. 5 is a circuit view showing one exemplary embodiment of a pixel used for the organic electro-luminescent display, as shown in FIG. 1.

FIG. 5 is a circuit view showing one embodiment of a pixel used for the organic electro-luminescent display as shown in FIG. 1. Referring to FIG. 5, the pixel includes a first transistor (M1), a second transistor (M2), a third transistor (M3), a capacitor (Cst) and an organic light emitting diode (OLED).

The first transistor (M1) has a source supplied to a first voltage (ELVDD); a drain coupled to a source of a third transistor (M3); and a gate coupled to a first node (N1). The second transistor (M2) has a source coupled to a data line (Dm); a drain coupled to a first node (N1); and a gate coupled to a scan line (Sn). The third transistor (M3) has a source coupled to a drain of the first transistor (M1); a drain coupled to an anode electrode of the organic light emitting diode (OLED); and a gate coupled to a light emission control line (En). The capacitor (Cst) has a first electrode coupled to a first power source; and a second electrode coupled to the first node (N1). The organic light emitting diode (OLED) includes an anode electrode, a cathode electrode, and a light emission layer arranged between the anode electrode and the cathode electrode, to emit light if an electric current flows from the anode electrode to the cathode electrode. The anode electrode is coupled to a drain of the third transistor (M3), and the cathode is coupled to the second power source (ELVSS).

In an operation of the pixel, if the scan signal is in a LOW state, to turn on the second transistor (M2), then the data signal supplied through the data line (Dm) is supplied to the first node (N1). Therefore the data signal is supplied to a second electrode of the capacitor (Cst). At this time, a voltage of the first voltage (ELVDD) is supplied to the first electrode of the capacitor (Cst). If the scan signal is in a HIGH state, to turn off the second transistor (M2), a floating state is formed between the first node (N1) and the data line (Dm), and a voltage of the first node (N1) sustains a voltage of the data signal using the capacitor (Cst). The voltage of the first node (N1) is supplied to a gate of the first transistor (M1), and then an electric current flows from the source to the drain electrode of the first transistor (M1), to correspond to the voltage of the first node (N1). At this time, the third transistor (M3) is turned on/off by means of the light emission control signal. In this case, the organic light emitting diode (OLED) does not emit light, since a flow of an electric current supplied to the organic light emitting diode (OLED) is interrupted, because the third transistor (M3) is turned off by the light emission control signal. The organic light emitting diode (OLED) emits light, since an electric current flows, in the organic light emitting diode (OLED), if the third transistor (M3) is turned on by the light emission control signal. The electric current capacity flowing in the organic light emitting diode (OLED) may be controlled by the pulse width of the light emission control signal, since a time when the third transistor (M3) is sustained with an ON state may be controlled by the pulse width of the light emission control signal.

The organic electro-luminescent display and the driving method of the same according to the present invention may be useful to reduce a power consumption and to enhance a contrast. Also, a large loading to the power supply unit may be prevented, by controlling an electric current flow if the pixels emit a high luminance at a beginning stage.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An organic electro-luminescent display comprising:

a pixel unit to display an image corresponding to a scan signal, a light emission control signal, and a data signal, the image comprising frames;

a scan driver to supply the scan signal and the light emission control signal to the pixel unit, according to a luminance control signal;

a data driver to generate the data signal from video data and to supply the data signal to the pixel unit;

a luminance control unit to control a pulse width of the light emission control signal using frame data values, which are sums of the video data input to each of the frames; and a power supply unit to supply a first voltage and a second voltage to the pixel unit, wherein the luminance control unit comprises:

a data sum-up unit to generate the frame data values;

a look-up table to store the frame data values and pulse widths of the light emission control signals corresponding to the frame data values;

an operator unit to generate the look-up table comprising steps of luminance reduction, by using one of the frame data values corresponding to a beginning step of luminance reduction, one of the frame data values corresponding to a final step of luminance reduction, one of the pulse widths corresponding to the beginning step of luminance reduction, and one of the pulse widths corresponding to the final step of luminance reduction; and a luminance control signal driver to output the luminance control signal, corresponding to one of the pulse widths stored in the look-up table, to the scan driver, wherein the operator unit calculates a pulse width variation of the light emission control signal by using the frame data value corresponding to the beginning step of luminance reduction, the frame data value corresponding to the final step of luminance reduction, the pulse width corresponding to the beginning step of luminance reduction, and the pulse width corresponding to the final step of luminance reduction, wherein the operator unit calculates pulse widths corresponding the steps of luminance reduction other that the beginning step and the final step, using pulse width variation, and wherein the operator unit stores the calculated pulse widths in the look-up table, and the pulse width variation is determined by the following Equation 1, $$\frac{Pulse_{final} - Pulse_{beginning}}{Value_{final} - Value_{beginning}}, \quad \text{Equation 1}$$

wherein $Pulse_{final}$ represents the pulse width corresponding to the final step of luminance reduction, $Pulse_{beginning}$ represents the pulse width corresponding to the beginning step of luminance reduction, $Value_{final}$ represents the frame data value corresponding to the final step of luminance reduction, and $Value_{beginning}$ represents the frame data value corresponding to the beginning step of luminance reduction.

2. The organic electro-luminescent display according to claim 1, wherein a pulse width of the light emission control signal is controlled according to the luminance control signal.

3. The organic electro-luminescent display according to claim 1, wherein the pixel unit controls a light emission time per frame to correspond to the light emission control signal.

4. The organic electro-luminescent display according to claim 1, wherein the scan driver is divided into a scan drive circuit to generate the scan signal, and a light emission control drive circuit to generate the light emission control signal.

5. The organic electro-luminescent display according to claim 1, wherein the pixel unit has a longer light emission time when the frame data value is smaller, and the pixel unit has a shorter light emission time when the frame data value is larger.

6. The organic electro-luminescent display according to claim 1, wherein the look-up table comprises a different pulse width corresponding to each of the steps of luminance reduction.

7. A method for making an organic electro-luminescent display, which displays an image comprising a plurality of frames, according to scan signals and light emission control signals, the method comprising:

selecting a frame data value for a beginning step of luminance reduction, a value at final step of luminance reduction, a pulse width of a light emission control signal at the beginning step of luminance reduction, a pulse width of a light emission control signal at the final step of luminance reduction;

storing a pulse width of the light emission control signal corresponding to the beginning step of luminance reduction at a step prior to the beginning step of luminance reduction; and generating a pulse width variation amount of the light emission control signals of adjacent steps using the value at the beginning step of luminance reduction, the value at the final step of luminance reduction, the pulse width of the light emission control signal at the beginning step of luminance reduction, and the pulse width of the light emission control signal at the final step of luminance reduction, to generate a pulse width of the light emission control signal, wherein the pulse width variation is determined by the following Equation 1:

$$\frac{Pulse_{final} - Pulse_{beginning}}{Value_{final} - Value_{beginning}}, \quad \text{Equation 1}$$

wherein $Pulse_{final}$ represents a pulse width of a light emission control signal at the final step of luminance reduction, $Pulse_{beginning}$ represents a pulse width of a light emission control signal at the beginning step of luminance reduction, $Value_{final}$ represents a value at the final step of luminance reduction, and $Value_{beginning}$ represents a value at the beginning step of luminance reduction.

8. The method for making an organic electro-luminescent display according to claim 7, wherein the steps are differentiated according to the size of frame data relating to each of the frames of the image.

9. The method of claim 8, wherein the frame data of each of the frames is a sum of video data input to each respective frame of the image.

10. A method for making a look-up table to compensate a brightness of an image including frames, displayed on an organic electro-luminescent display, according to scan signals and light emission control signals, the method comprising:

determining frame data values of each of the frames, and arranging the frame data values in the look-up table, as steps, from a lowest one of the frame data values to a highest one of the frame data values;

determining a luminance reduction range corresponding to a group of the steps;

storing a first pulse width of a light emission control signal corresponding to a first step of the group, and a last pulse width for a light emission control signal corresponding to a last step of the group, in the look-up table;

determining a pulse width variation amount using the first pulse width, the last pulse width, the frame data value of the first step of the group, and a frame data value of the last step of the group; and using the pulse width variation amount to calculate pulse widths corresponding to the steps of the group other than the first step and the last step, and storing the calculated pulse widths in the look-up table, wherein the pulse width variation amount is calculated according to the following equation:

(the last pulse width−the first pulse width)/(the highest frame data value−the lowest frame data value).

11. The method of claim 10, further comprising storing the first pulse width, as pulse widths of corresponding to the steps preceding the group, in the look-up table.

12. The method of claim 10, further comprising storing the last pulse width, as pulse widths corresponding to the steps subsequent to the group, in the look-up table.

13. The method of claim 10, wherein the pulse widths of consecutive steps of the group vary by the pulse width variation amount.

14. The method of claim 10, wherein the frame data values approximate grey levels of the frames.

* * * * *

UNITED STATES PATENT AND TRADEMARK OFFICE

CERTIFICATE OF CORRECTION

PATENT NO. : 7,986,286 B2
APPLICATION NO. : 11/951517
DATED : July 26, 2011
INVENTOR(S) : Young-Jong Park et al.

It is certified that error appears in the above-identified patent and that said Letters Patent is hereby corrected as shown below:

In the Claims

| | |
|---|---|
| Column 9, Claim 1, line 28. | After "corresponding"<br>Insert -- to -- |
| Column 9, Claim 1, line 28. | Delete "that"<br>Insert -- than -- |
| Column 10, Claim 7, line 8. | After "reduction,"<br>Insert -- and -- |
| Column 11, Claim 11, line 9. | Delete "of" |

Signed and Sealed this
Fourth Day of September, 2012

David J. Kappos

David J. Kappos
*Director of the United States Patent and Trademark Office*